United States Patent [19]

Sharpe

[11] 4,111,369

[45] Sep. 5, 1978

[54] FUEL NOZZLE

[75] Inventor: Cecil H. Sharpe, Brownsburg, Ind.

[73] Assignee: General Motors Corporation, Detroit, Mich.

[21] Appl. No.: 813,168

[22] Filed: Jul. 5, 1977

[51] Int. Cl.[2] ..... B05B 7/10

[52] U.S. Cl. ..... 239/400; 239/406

[58] Field of Search ..... 239/400, 404, 406, 533; 60/39.74 R

[56] References Cited

U.S. PATENT DOCUMENTS

| | | | |
|---|---|---|---|
| 2,701,164 | 2/1955 | Purchas et al. | 239/400 |
| 3,024,045 | 3/1962 | Cleminshaw et al. | 239/404 |
| 3,159,971 | 12/1964 | Moebius et al. | 60/39.74 R |
| 3,662,959 | 5/1972 | Sample, Jr. | 239/533 |
| 3,684,186 | 8/1972 | Helmrich | 239/400 |
| 3,713,588 | 1/1973 | Sharpe | 239/400 |
| 3,790,086 | 2/1974 | Masai | 239/406 |
| 4,070,826 | 1/1978 | Stenger et al. | 60/39.74 R |

*Primary Examiner*—Bruce H. Stoner, Jr.
*Assistant Examiner*—Michael J. Forman
*Attorney, Agent, or Firm*—J. C. Evans

[57] ABSTRACT

An air blast fuel nozzle for a gas turbine engine includes a take apart head assembly having a large diameter air swirler for fuel flow from a pilot fuel distributor tube that is telescoped centrally within a take apart main fuel distributor and pilot nozzle element having means therein to form a thermal barrier air gap around the pilot fuel distributor tube and wherein the assembly further includes a main fuel distributor head having open ended axial fuel passages therethrough for supplying fuel to a main fuel distributing ring on the outboard end of the assembly immediately upstream of the air swirler.

3 Claims, 3 Drawing Figures

FUEL NOZZLE

The invention herein described was made in the course of work under a contract or subcontract thereunder with the Department of Defense.

This invention relates to fuel spray nozzles and more particularly to fuel spray nozzles for supplying an air fuel mixture into a combustor apparatus of a gas turbine engine.

Fuel injection nozzles for gas turbine engines have a passage therein for main fuel flow and an additional pilot for primary fuel flow. Fuel flow through these passages is associated with air flow to produce atomization of the fuel droplets prior to passage from the nozzle assembly into the combustion apparatus.

Moreover, such nozzle assemblies are located in the dome of combustion apparatus and are exposed to a flame front within a primary combustion zone of the combustion apparatus. Various proposals have been suggested to produce fine droplet atomization of fuel flow from such nozzles. For example, in U.S. Pat. No. 3,713,588 issued Jan. 30, 1973, to Cecil H. Sharpe, an air swirler is located in surrounding relationship to fuel passages in a fuel injection nozzle located in a high temperature region of a gas turbine engine. While such air swirlers are satisfactory for fuel atomization of fuel flow therefrom, it has been observed that following shut down of an engine heat soak of the fuel injection nozzle can cause a temperature increase that will carbonize or break down fuel that remains within the nozzle assembly. Accordingly, a varnish layer can occur in the fuel passages within the nozzle portions of the structure.

An object of the present invention is to improve fuel spray nozzles for association with gas turbine engines by the provision of a take apart unit having pilot and primary fuel passages therein and means for defining air gap barriers to thermally insulate the walls of the fuel passages from high temperature conditions during a heat soak phase of gas turbine engine operation so as to prevent carbonization or breakdown of fuel remaining in the nozzle and thereby prevent a build-up of varnish in the pilot and main fuel passages through the nozzle assembly.

Another object of the present invention is to provide an improved air blast fuel spray nozzle for dispersing liquid fuel into a combustion apparatus for a gas turbine engine wherein the fuel spray nozzle is exposed to a high temperature soak phase of operation and includes take apart pilot and main fuel distributor means telescoped on one another and wherein a pilot fuel nozzle is telescoped over a pilot fuel tube with means therebetween for defining a first air space defining a thermal barrier to the internal walls of the pilot fuel tube during a soak phase of operation; and wherein the pilot nozzle telescopingly receives a main fuel distributor having open ended axial passages formed therethrough to communicate a main fuel distributor being associated with means for defining a gap in surrounding relationship thereto to provide an insulating air gap thermal barrier therearound to prevent varnish build-up in the main fuel distributor during a heat soak phase of operation and wherein the main fuel flow path also is buried in a solid strut tip to reduce thermal heating of the interior walls thereof.

Yet another object of the present invention is to provide an improved fuel distributing nozzle spray head having take apart components each of which are separately removable and each of which have either a pilot or main fuel flow path therethrough that can be cleaned by directing a cleaning tool through a straight open ended passage in each of the separate parts thereby to improve maintenance and cleanability of the spray nozzle following operation thereof under high temperature conditions.

Further objects and advantages of the present invention will be apparent from the following description, reference being had to the accompanying drawings wherein a preferred embodiment of the present invention is clearly shown.

Figure 1:
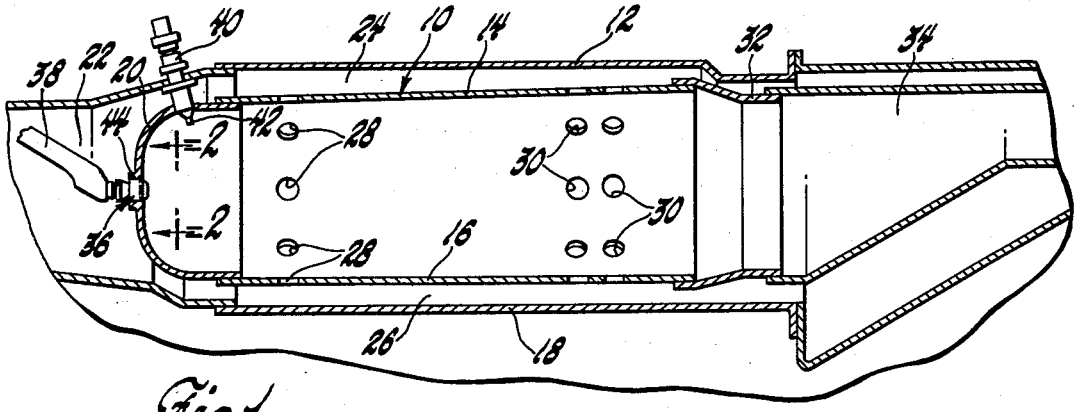
FIG. 1 is a fragmentary view of a gas turbine engine combustor assembly including the fuel spray nozzle of the present invention in association therewith.

Fuel nozzles in accordance with the present invention are associated with a gas turbine engine combustion apparatus 10 of the type shown in FIG. 1. It should be understood that FIG. 1 is a somewhat schematic or simplified representation of a conventional combustion apparatus of the annular type for a gas turbine aircraft engine. However, the fuel nozzle of the present invention is equally suitable for use with a vertically oriented generally cylindrical can type automotive gas turbine engine combustor of the type set forth in U.S. Pat. No. 3,656,298 issued Apr. 18, 1972. The combustion apparatus 10 in FIG. 1 includes an outer annular wall 12 which is part of the casing of the engine. It is located in spaced relationship to an inner annular wall 14 defining an outer combustion liner which is disposed generally in parallel relationship to an inner combustor wall 16 that is spaced from an inner engine wall 18.

The combustion apparatus 10 includes a forward end or dome 20 that is located immediately upstream of a diffuser passage 22 in communication with the discharge of a compressor, not shown, for discharging compressed air through the diffuser passage 22 into an outer air space 24 and an inner air space 26 to supply primary combustion air holes 28 at the upstream end of the combustion apparatus 10 and to supply dilution airholes 30 that are located upstream of a transition section 32 leading to an exhaust duct 34 of the engine.

The details of the combustion liner and of the air entrance opening thereto are subject to variation and follow known practice.

Fuel supply to combustion apparatus 10 is directed from a fuel nozzle 36 supported by a strut 38 from the outer engine wall 12 and located within the inlet diffuser passage 22. An igniter 40 is also supported by the outer wall 12 and includes a spark tip 42 thereon located within the dome 20 for igniting fuel directed thereto from the nozzle 36.

In the illustrated arrangement the fuel nozzle 36 is mounted at the center of the dome 20. The dome has a forwardly projecting flange or ferrule 44 that defines a circular opening for the fuel nozzle 36 that serves in turn as a support for the upstream end of a combustor apparatus 10.

The fuel nozzle 36 includes a generally cylindrical outer shell or ring 46 that is supportingly received within the ferrule 44 and defining the outer boundaries of an air blast swirler 48 that overlies the outlet end 50 of a take apart fuel distributor assembly 52.

The fuel distributor assembly 52 more particularly includes a removable, center located, pilot nozzle 54 that is telescoped within a main fuel distributor 56 to supply a main fuel distributor ring 58.

More particularly, in the illustrated arrangement, the strut 38 includes a solid metal tip 60 on one end thereof with a pilot fuel passage 62 located centrally thereof and an axially directed main fuel passage 64 therethrough. The solid metal tip 60 has an externally threaded surface 65 that threadably receives a tapped bore 66 in the end of a bushing 68 that includes a conical segment 70 thereon with an internal shoulder 72 that supportingly engages a shoulder 74 of the main fuel distributor 56. The bushing 68 further includes an elongated tubular nose 76 thereon that supportingly receives an inner surface 78 of the air blast swirler ring 48 for axially locating it with respect to the internal, take apart components of the fuel distributor assembly 52.

In accordance with certain principles of the present invention the bushing 68 is fixedly connected to the strut 38 by an annular sheet metal shroud 80 having one end thereof sealingly connected to strut 38 by means of a continuously formed weld bead 81. The opposite end of the shroud 80 is sealed by a continuous weld bead 83 to an undercut shoulder 85 on the outer surface of the inboard end of the bushing 68.

Shroud 80 is easily removed from the strut 38 and the bushing 68 for purposes of access to the internal take apart components as part of a scheduled maintenance program. While in place, shroud 80 assures a positive connection of the parts during nozzle operation while affording a thermal barrier 79 to reduce heat transfer from exterior of the nozzle 36 to the main fuel passage 64 and the pilot fuel passage 62. The sheet metal shroud 80 abutment with shoulder 85 produces a sufficient interruption or clearance to produce a thermal barrier effect which will reduce carbonization of fuel within the passages 62, 64 during a heat soak phase of operation.

The fuel distributor assembly 52 is further configured to define additional thermal barriers to prevent fuel carbonization and varnish build up within the fuel flow passages of the assembly 52 during the heat soak phase of operation.

More particularly, the solid metal tip 60 includes a recess 82 in the end thereof that supportingly receives a base 84 on the center located pilot nozzle 54. The base 84 includes a tubular extension 86 formed integrally therewith with an orifice 88 formed at the end of the extension 86 defining the outlet of the pilot nozzle 54.

The tubular extension 86 includes an internal bore 90 that supportingly receives a pilot fuel distributor tube 92 having an elongated outer, annular undercut axially extended surface 94 formed thereon to define an air space or gap 96 between the tube 92 and the inner surface of the extension 86 to define an internal air gap barrier around a pilot fuel passage 98 through the tube. Passage 98 communicates the passage 62 with a plurality of pilot fuel openings 100 in the tube that lead to the orifice 88 at the outlet end 50 of the center located pilot nozzle 54.

The air gap 96 defines an effective thermal barrier to prevent build up of fuel varnish within the passage 98 and in the small diameter pilot fuel holes 100 which are in the order of 0.015 inches in diameter and susceptible to fouling. Pilot air flow through hole 102 provides air to prevent air/fuel flow reversal created by low pressure area of vortex made by swirler vane 132. The hole 102 communicates with an annular opening 104 defined between the bushing 68 and the outer surface of the main fuel distributor 56. It, in turn, includes a slant opening 106 therethrough that communicates the space 104 with an annular axially extending passage 108 that has an outlet 110 in surrounding relationship to the orifice 88.

The aforedescribed annular space 104 defines a further air gap serving as an additional thermal barrier about the main fuel distributor 56 to thermally isolate it against the high temperature environment in surrounding relationship thereto.

Additionally, the annular passage 108 for supplying pilot air also defines an air gap for further thermal insulation of the take apart center located fuel distributor assembly 52.

Figure 3:
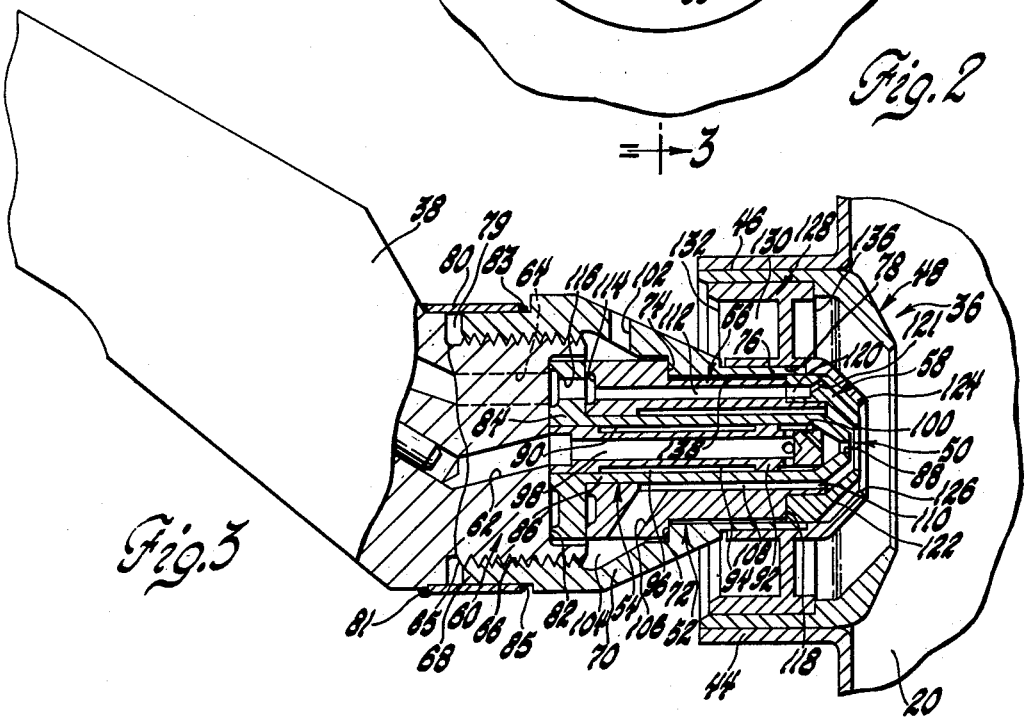
FIG. 3 is a fragmentary, longitudinal sectional view of the spray nozzle of the present invention taken along the line 3—3 of FIG. 2 looking in the direction of the arrows.

The main fuel distributor 56, as shown in FIG. 3, is telescopingly received over the outer surface of the pilot fuel distributor tube 92. It is located by the shoulders 72, 74 with respect to the bushing 68 and further includes a plurality of open ended, axially directed fuel passages 112 therethrough, one of which is illustrated in FIG. 3. Each of the fuel passages 112 is in communication with an annular groove 114 formed on the inboard end of the distributor 56. Groove 114 overlies a supply passage 116 in the base 84 of the pilot nozzle 54. The passage 116 communicates passage 64 with the main fuel distributor 56 leading to the fuel distributor ring 58.

The axial, straight through configuration of the passages 112 permit straight through removal of fuel varnish build up when the take apart parts are disassembled.

The distributor tube 56 has a stepped end 118 that supportingly receives the fuel director ring 58 welded to 56. The fuel director ring 58 has passages 120 aligned with passages 112 therein that leads to a plurality of slant holes 121 to create swirling conical main fuel flow between an inclined surface 122 on the distributing ring 58 and an overlying tip 124 of the air blast swirler ring 48.

Figure 2:
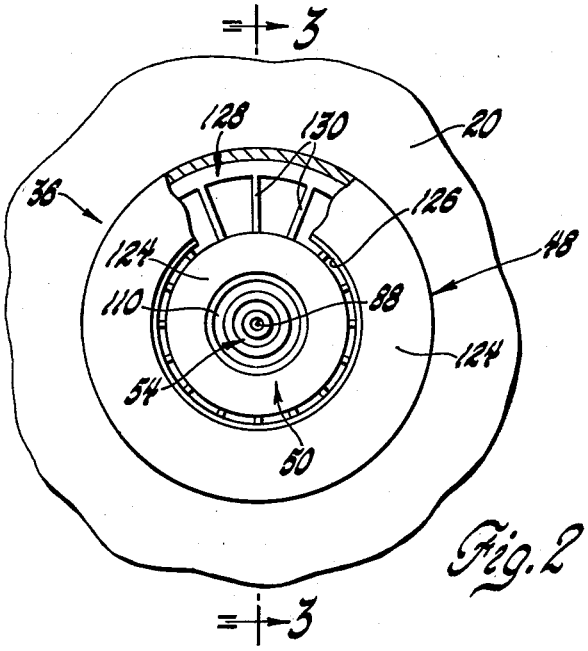
FIG. 2 is a fragmentary, enlarged end elevational view taken along the line 2—2 of FIG. 1 looking in the direction of the arrows.

A thin conical film of main fuel flow passes by the tip 124 through a large diameter opening 126 formed centrally thereof into air blast flow from a ring 128 of air swirler vanes 130, one of which is shown in FIG. 2. Each vane 130 has an inlet edge 132 thereon and an outlet 136 to produce a tangential swirl of air flow from the air blast swirler ring 48 that is directed into the interior of the fuel spray cone that issues from the opening 126.

In the illustrated arrangement, pilot nozzle 54 is utilized to start the engine and to maintain combustion during minimum fuel flow conditions, for example, during deceleration of the engine.

The major pattern of fuel supplied to the engine is supplied through the passage 64 and through the fuel distributor ring 58. The diameters of the slant holes 121 are selected to prevent excessive build up of deposits thereon and the air gaps defined by the space 104, and an annular clearance space 138 formed between the main fuel distributor tube 56 and the tubular nose 76 will reduce build up of fuel varnish or carbon deposits.

The unit is shown assembled in FIG. 3. To disassemble the component parts for quick maintenance, the sheet metal shroud 80 is cut away from the shoulder 85 so that the bushing 68 can be threadably removed from the strut tip 60. The center located pilot nozzle 54 is then accessible from the opening end of the bushing and can be slidably removed from the interior of the main fuel distributor 56 which is telescoped thereover. The pilot distributor tube 92 can be removed for inspection, replacement or cleaning of the small diameter pilot holes 100 therein. Then, the orifice 88 is accessible for cleaning.

The main fuel distributor 56 is then removed from its seated position on the shoulder 72 for inspection of the straight through passages 112 and for removal of any fuel deposit build up therein. The fuel distributor ring 58 which is a part of 56 is removed along with the main fuel distributor and can then be cleaned and inspected.

The air blast ring 48 is welded to the ring 128 and is removed as a unitary part thereof. The conical end portion of air shroud ring 48 provides a thin wall at the exit orifice but increases in thickness (mass) to provide additional mass for heat transfer in the conical portion thereof. The individual parts are easily reassembled to maintain the desired, multiple, thermal air gap configuration therethrough and can be reconnected by threading the bushing 68 onto the strut tip 60 and thereafter welding a new shroud in place to hold the nozzle securely on the strut 38.

While the embodiments of the present invention, as herein disclosed, constitute a preferred form, it is to be understood that other forms might be adopted.

The embodiments of the invention in which an exclusive property or privilege is claimed are defined as follows:

1. A fuel spray nozzle for disbursing liquid fuel into a combustion apparatus and wherein the nozzle is exposed to high temperature combustion within the combustion apparatus comprising: a nozzle strut end of solid metal having main and pilot fuel supply passages therethrough, an outboard recess in said strut end, a pilot nozzle having a base thereon removably supported within said recess, said pilot nozzle including an elongated tubular extension thereon with a pilot nozzle orifice at its end, a pilot fuel distributor tube slidably supported within said tubular extension, coacting means on said tubular extension and said pilot fuel distributor tube to define an air space and thermal barrier against heat transfer to fuel within said pilot fuel distributor tube during a heat soak mode of spray nozzle operation thereby to prevent build-up of fuel varnish within said pilot fuel distributor tube with resultant blockage of pilot fuel passages within the spray nozzle, a main fuel distributor having a segment telescoped on and removably supported by said elongated tubular extension, said segment including a fuel passage means in communication with said strut main fuel supply passage, an integral extension formed on said segment and having axial fuel passages communicated with said fuel passage means, said axial fuel passages having opposite aligned open ends for straight line flow of fuel and straight line removal of fuel varnish build up therein, a main fuel distributing ring with axial inlet passages and inclined outlet ports therein, said integral extension having a stepped ring support thereon to removably receive said fuel distributing ring and to locate it in spaced, overlying relationship to said pilot nozzle, air distributor means for supplying air to said pilot nozzle including a bushing in surrounding relationship to said main fuel distributor, said bushing including a locater shoulder thereon coacting with said main fuel distributor to hold it against said pilot nozzle base which is in turn held thereby against said nozzle strut end, means for removably connecting said bushing to said strut end for take apart assembly of said pilot nozzle, pilot fuel distributor tube and said main fuel distributor.

2. A fuel spray nozzle for disbursing liquid fuel into a combustion apparatus and wherein the nozzle is exposed to high temperature combustion within the combustion apparatus comprising: a nozzle strut end of solid metal having main and pilot fuel supply passages therethrough, an outboard recess in said strut end, a pilot nozzle having a base thereon removably supported within said recess, said pilot nozzle including an elongated tubular extension thereon with a pilot nozzle orifice at its end, a pilot fuel distributor tube slidably supported within said tubular extension, coacting means on said tubular extension and said pilot fuel distributor tube to define an air space and thermal barrier against heat transfer to fuel within said pilot fuel distributor tube during a heat soak mode of spray nozzle operation thereby to prevent build up of fuel varnish within said pilot fuel distributor tube with resultant blockage of pilot fuel passages within the spray nozzle, a main fuel distributor having a segment telescoped on and removably supported by said elongated tubular extension, said segment including a fuel passage means in communication with said strut main fuel supply passage, an integral extension formed on said segment and having axial fuel passages communicated with said fuel passage means, said axial fuel passages having opposite aligned open ends for straight line flow of fuel and straight line removal of fuel varnish build up therein, a main fuel distributing ring with axial inlet passages and inclined outlet ports therein, said integral extension having a stepped ring support thereon to removably receive said fuel distributing ring and to locate it in spaced, overlying relationship to said pilot nozzle, air distributor means for supplying air to said pilot nozzle including a bushing in surrounding relationship to said main fuel distributor, said bushing including a locater shoulder thereon coacting with said main fuel distributor to hold it against said pilot nozzle base which is in turn held thereby against said nozzle strut end, means for removably connecting said bushing to said strut end for take apart assembly of said pilot nozzle, pilot fuel distributor tube and said main fuel distributor, and an outboard main air swirler including means to converge main air flow and fuel flow from said ports prior to passage thereof into a combustor apparatus combustion zone.

3. A fuel spray nozzle for disbursing liquid fuel into a combustion apparatus and wherein the nozzle is exposed to high temperature combustion within the combustion apparatus comprising: a nozzle strut end of solid metal having main and pilot fuel supply passages therethrough, an outboard recess in said strut end, a pilot nozzle having a base thereon removably supported within said recess, said pilot nozzle including an elongated tubular extension thereon with a pilot nozzle orifice at its end, a pilot fuel distributor tube slidably supported within said tubular extension, coacting means on said tubular extension and said pilot fuel distributor tube to define an air space and thermal barrier against heat transfer to fuel within said pilot fuel distributor tube during a heat soak mode of spray nozzle operation thereby to prevent build up of fuel varnish within said pilot fuel distributor tube with resultant blockage of pilot fuel passages within the spray nozzle, a main fuel distributor having a segment telescoped on and removably supported by said first elongated tubular extension said segment including fuel passage means in communication with said main fuel supply passages, an integral extension formed on said segment and having axial fuel passages communicated with said fuel passage means, said axial fuel passages having opposite aligned open ends for straight line flow of fuel and straight line removal of fuel varnish build up therein, a main fuel distributing ring with axial inlet passages and inclined outlet ports therein, said integral extension having a stepped ring support thereon to removably receive said fuel distributing ring and to locate it in spaced, overlying relationship to said pilot nozzle, air distributor means for supplying air to said pilot nozzle including an outer bushing removably supported on said strut end, a thin ring shroud connected between said bushing and said nozzle strut end to form a dead air space around fuel passages in said nozzle strut end to reduce heat transfer during the aforesaid heat soak mode of operation, said bushing including a conical segment defining an air space outboard of said strut end and in surrounding relationship to the base of said main fuel distributor to thermally isolate it against heat transfer during the heat soak mode, said conical segment including a locator shoulder thereon coacting with said main fuel distributor to hold it against said pilot nozzle which is in turn held thereby against said nozzle strut end.

* * * * *